US008161786B2

(12) United States Patent
Stapleton

(10) Patent No.: US 8,161,786 B2
(45) Date of Patent: Apr. 24, 2012

(54) APPARATUS FOR FEEDING AND TURNING TUBE PRODUCTS INTO A PILGER MILL MACHINE

(76) Inventor: Glen Stapleton, Carlsbad, CA (US)

( * ) Notice: Subject to any disclaimer, the term of this patent is extended or adjusted under 35 U.S.C. 154(b) by 843 days.

(21) Appl. No.: 12/235,813

(22) Filed: Sep. 23, 2008

(65) Prior Publication Data

US 2009/0255312 A1 Oct. 15, 2009

Related U.S. Application Data

(60) Provisional application No. 61/045,102, filed on Apr. 15, 2008.

(51) Int. Cl.
*B21B 39/20* (2006.01)
*B65H 20/00* (2006.01)

(52) U.S. Cl. ..... 72/251; 72/428; 72/95; 226/172

(58) Field of Classification Search ..... 72/214, 72/249, 251, 244, 245, 422, 426, 428, 449, 72/257, 95, 77, 78; 226/171, 172
See application file for complete search history.

(56) References Cited

U.S. PATENT DOCUMENTS

| | | | | |
|---|---|---|---|---|
| 3,659,446 | A | 5/1972 | Gerretz et al. | |
| 3,862,560 | A | 1/1975 | Grinshpun et al. | |
| 4,005,595 | A | 2/1977 | Gerretz et al. | |
| 4,037,444 | A | 7/1977 | Ledebur et al. | |
| 4,100,786 | A | 7/1978 | Dorp et al. | |
| 4,145,906 | A | 3/1979 | Makarkin et al. | |
| 4,184,352 | A | 1/1980 | Potapov et al. | |
| 4,203,309 | A | 5/1980 | Ermakov et al. | |
| 4,285,226 | A | 8/1981 | Gancia | |
| 4,658,617 | A | 4/1987 | Peytavin | |
| 4,713,955 | A | 12/1987 | Peytavin | |
| 4,724,697 | A | 2/1988 | Hien et al. | |
| 4,956,988 | A | 9/1990 | Fischer et al. | |
| 5,035,132 | A | 7/1991 | Gerretz | |
| 5,109,598 | A * | 5/1992 | Koch | 29/825 |
| 6,257,040 | B1 | 7/2001 | Baensch et al. | |
| 2007/0175014 | A1 | 8/2007 | Van Nguyen | |

* cited by examiner

*Primary Examiner* — Debra Sullivan

(74) *Attorney, Agent, or Firm* — Kelly & Kelley, LLP

(57) ABSTRACT

Incoming tubes are turned and fed into a pilger mill by use of a single gearbox using a rotating dual track drive system. The dual track system holds the incoming tube while tube reducing (metal tube forming) occurs by the pilger tooling. When the pilger tooling is free of the incoming tube product, the dual track drive moves the tube into the pilger tooling by feeding an incremental amount of tube product. The dual track drive also indexes the incoming tube at the correct time and at a pre-determined amount. Additionally, the gearbox sub-assembly bumps the tube at a pre-determined time while the tube is free from the tooling.

21 Claims, 11 Drawing Sheets

APPARATUS FOR FEEDING AND TURNING TUBE PRODUCTS INTO A PILGER MILL MACHINE

BACKGROUND OF THE INVENTION

One of the existing methods of producing medium to large quantities of metal tubing is through the use of pilger mills, also known as tube reducers. Another method to produce metal tubing is cold drawing but it is typically only used for small quantities of tubing. Pilger mill machines have been producing metal tubing since 1880 and are considered to be an efficient manufacturing process for significant quantities. The fundamental methods to form tubing from the pilger mill is with the use of an upper and lower die, rolling back and forth over a mandrel. This method was established in 1880 by the Mannesmann brothers of Germany when they patented a hot working of tubes.

In 1896, an American engineer patented the first cold pilger mill. The process principle has not changed since then but the supporting mechanisms have changed over the years many times. Many patents have been issued using new technology to support the same pilger principle. As the pilger principles utilize tooling to reduce the tube products, supporting mechanisms within the current day process are vital and crucial to the updated functions.

In general, each pilger machine has a major drive mechanism that provides a linear motion to the tooling, known as a stroke. Many of the machines in use today use a crankshaft for the linear movement. As the tooling consists of an upper & lower die that rolls back and forth over the tube product. A stationary rotating mandrel is located within the tube inside diameter.

Both top & bottom dies have a pre-shaped groove which forms or re-shapes the tube product smaller on each stroke. As the top & bottom dies form the outside diameter of the tube to a smaller size, the mandrel and the dies together also work the tube wall into a smaller size. As the dies roll back & forth, the tube product is fed into the dies and over the stationary rotating mandrel. While the tube is reduced in size of outside diameter and inside diameter, the tube also becomes elongated.

The supporting mechanisms that provide the vital functions on today's pilger mills are done thru the use of various gearboxes. All of these current gearboxes provide 3 basic functions directly to the incoming tube for the typical pilger process. They provide tube turning (or indexing), incremental feeding, and bumping of the incoming tube over the rotating mandrel. The stationary mandrel rotation is also provided by two of the gearboxes and is mechanically driven from within the gearboxes.

Current pilger mill machines perform these three functions, along with pilgering (forming) the tube, for a continuous operation. A continuous operation means that the pilger machine operates without stopping the machine to load new incoming tubes. Older generations of pilger mills have to stop and load one tube and then operate for that one tube, then stop to load the next incoming tube.

As a continuous pilger mill operation, many of these machines have 4 gearboxes that service the previously mentioned functions, turning, feeding and bumping. One gearbox, referred to as an upper gear train gearbox, transfers the rotary motion from a crankshaft, or other rotary drive, to three other gearboxes via a line shaft mechanism. A second gearbox, as driven by the line shaft, transfers the rotary motion into turning of the incoming tube and mandrel lock. The third gearbox, as driven by the line shaft, transfers the rotary motion into turning of the incoming tube. Also, this third gearbox provides feeding and bumping of the incoming tube as well as operating a mandrel lock. The forth gearbox, as driven by the line shaft, transfers the rotary motion into turning of the incoming tube. Also, this forth gearbox provides feeding of the incoming tube.

As described in U.S. Pat. No. 5,035,132 by Josef Gerretz, multiple gearboxes were used in order to achieve a continuous operation of the pilger mill. These multiple gearboxes provided the necessary feeding and turning of the incoming tubes. Other related patents enhance this continuous mill operation. The disadvantage to this patent is that it does not perform any of the necessary bumping of the tube products which is very important to many of the pilger processes. Also, this patent fails to describe how the device grips the tube product.

As described in U.S. Pat. No. 6,257,040, by Michael Beansch, Wolfgang Ernhardt, Bernhard Gromada, Ernst Holler, Horst Mattes, the inventors replaced the older mechanical drives of the 1960s with updated technology. The improved controls of the hydraulic drives, are an improvement to the pilger process. These drives still provide the same necessary feeding and turning of the incoming tubes in all of the gearboxes. The disadvantage of this patent effort is it still requires multiple gearboxes.

Other related patents continue to promote or enhance the continuous pilger mill operation using two or more gearboxes to support the necessary feeding & turning of the tube into the pilger tooling. The disadvantage of the use of multiple gearboxes is the large cost of operation and maintenance that is required to maintain the necessary supporting functions of feeding & turning. A large percentage of the initial cost of investment into a pilger mill is in the complex gearboxes. Also, the maintenance cost of two or four gearboxes is staggering over time as the machine experiences normal wear.

Accordingly, there is a need for a pilger mill device that performs the necessary functions of indexing, feeding, bumping and mandrel rotation with fewer gearboxes. The present invention satisfies this need and provides other related advantages.

SUMMARY OF THE INVENTION

The present invention allows the necessary pilger mill supporting functions of feeding, turning and bumping to be performed in one gearbox only, therefore replacing anywhere from two to four gearboxes in prior art devices. The cost savings on the initial machine investment, as well as the saving on the long term maintenance of the gearboxes is extremely large.

The present invention is directed to a single gearbox for providing feed, index and bump motion of tube product in a pilger mill. The gearbox includes a sub-assembly that comprises a track drive including a linearly rotating track for feeding the tube product along a longitudinal axis of the sub-assembly. The sub-assembly also includes an end support attached to an end thereof for rotating the sub-assembly about the longitudinal axis, thereby indexing the tube product. The sub-assembly also includes a hydraulic ring cylinder attached to an end thereof for shifting the sub-assembly along the longitudinal axis, thereby bumping the tube product.

The track drive comprises a dual track drive having two linearly rotating tracks, wherein each track is comprised of a looped series of segmented clamps contoured to the shape of the tube product. The track drive further includes a slide-wedge assembly for forcing a portion of the linearly rotating track against the tube product. With two linearly rotating tracks, the slide-wedge assembly forces opposing portions of the tracks against the tube product. The end support may comprise a pair of end supports attached to opposite ends of the sub-assembly. Further, a rotary union is attached to an end of the sub-assembly for providing a point of connection for an external pneumatic or hydraulic source to the sub-assembly. The pneumatic or hydraulic source being for actuating a cylinder acting on the slide-wedge assembly.

An electrical slip ring is attached to an end of the sub-assembly for providing a point of connection for an external electrical source to the sub-assembly. The electrical source for powering a servo motor acting on the track drive. A ring bearing is disposed proximate to a longitudinal midpoint of the sub-assembly, the ring bearing being operatively connected to a gearbox casing to facilitate rotating of the sub-assembly about the longitudinal axis. The ring bearing may comprise a pair of ring bearings uniformly spaced about the longitudinal midpoint of the sub-assembly. Further, a servo drive may be included on the gearbox casing for acting on the end support to rotate the sub-assembly.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
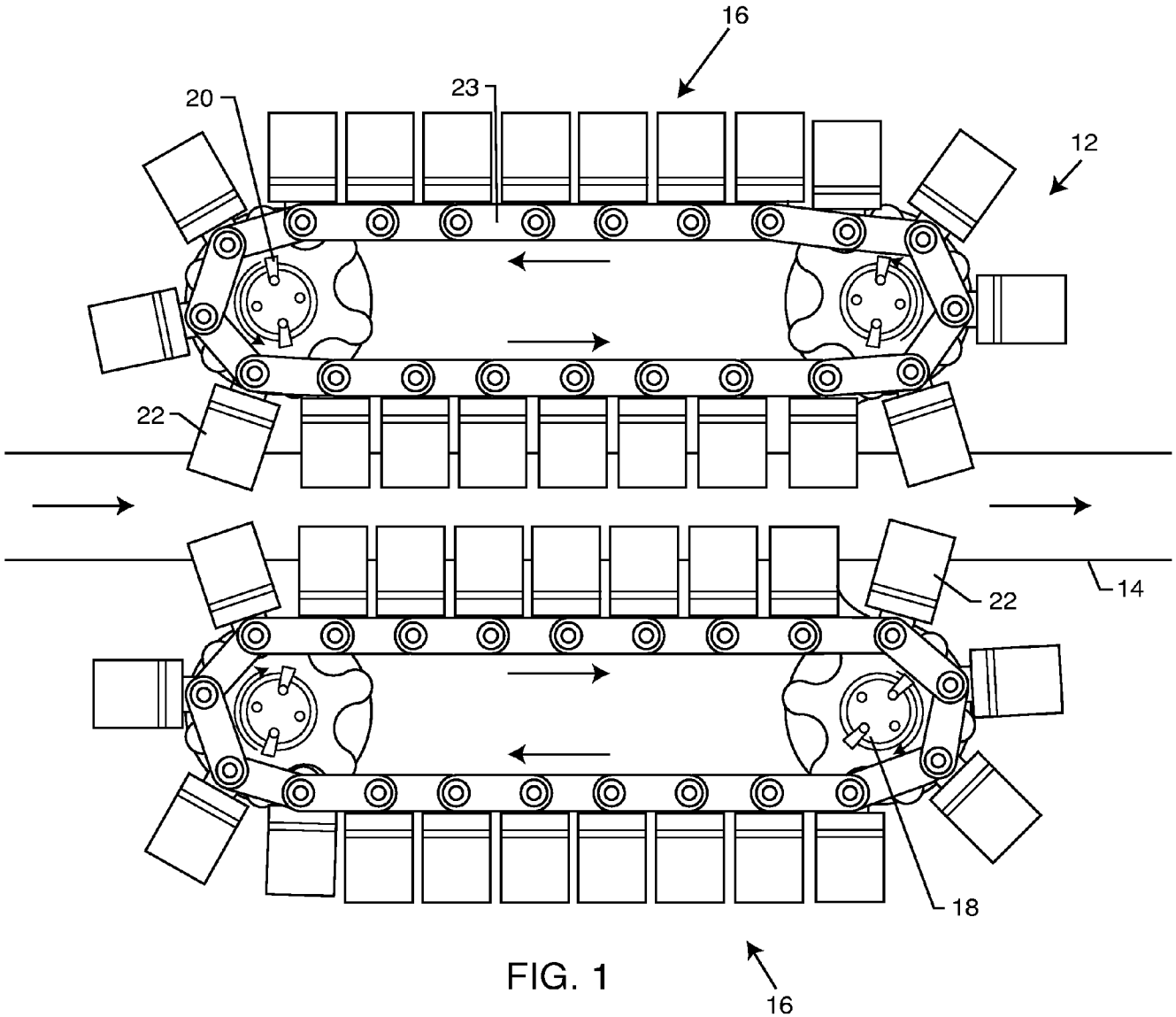
FIG. 1 illustrates the dual track drive of the present invention.

As shown in the accompanying drawings, for purposes of illustration, the present invention is directed to a new device for feeding and turning metal tube products within a tube reducer or pilger mill. For ease of understanding, the drawings illustrate the piecewise assembly of the inventive gearbox, generally referred to by reference numeral 10. This described "assembly" of the gearbox 10 is only for purposes of describing a sub-assembly 11 and is not intended to limit the manner in which the gearbox 10 is manufactured.

The inventive gearbox 10 includes a dual track drive 12 that is more efficient and provides quality delivery of metal tube product 14 to the tooling of a pilger mill or tube reducing machine (not shown). The gearbox 10 provides for a continuous machine operation without work stoppage. The feeding and turning functions of the gearbox 10 are both infinitely adjustable with the use of computer controls to variable drive motors. The inventive device results in a reduction of the number of gearboxes needed to perform the task of feeding and turning the incoming tube 14 to the pilger mill tooling. Comparatively, for prior art pilger mill machines that perform the same functions, the number of gearboxes is reduced from three or four gearboxes to only one gearbox.

Figure 2:
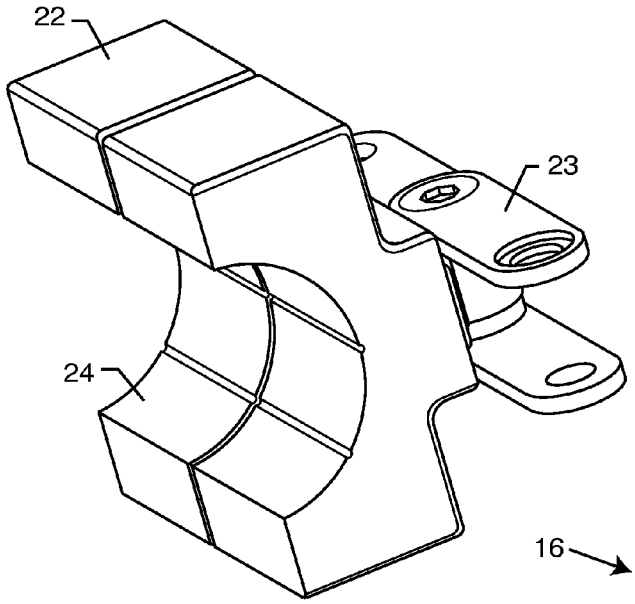
FIG. 2 illustrates one of the segmented clamps of the dual track drive.

FIG. 1 shows the dual track drive 12 and how the motion of a dual track system feeds a tube in a forward direction (arrows) towards the pilger mill. Preferably, the dual track drive 12 includes two linearly rotating tracks 16 positioned opposite one another. However, the track drive 12 may include only a single track 16 positioned opposite a surface that permits the tube product to slide thereon, i.e., essentially frictionless. Each track 16 has a drive sprocket 18 which drives the track 16. An idler sprocket 20 is also used to complete the circular motion of the track 16. The track 16 consists of a plurality of segmented or individual clamps 22, as illustrated in FIG. 2, joined in a loop by linkage and pins 23 which have the same or similar shape or contour 24 as the metal tube product 14.

Figure 3:
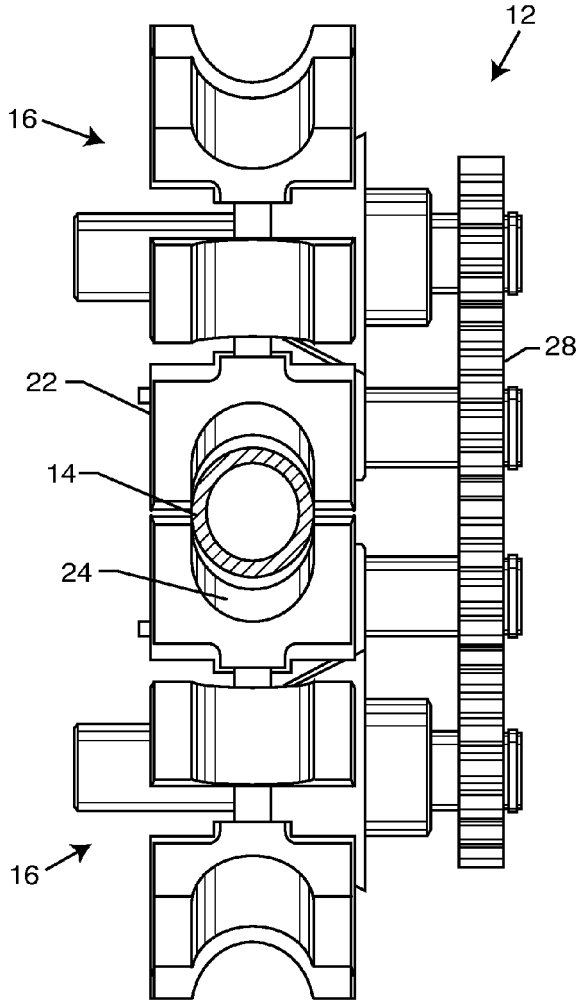
FIG. 3 is an end view of the dual track drive of the present invention.

FIG. 3 shows an end view of the dual track drive 12 and the contour 24 of the track segments 22. The segment contour 24 makes contact with the outside diameter of the tube 14 spanning approximately half of the tube circumference. Several sequential segments 22 of the track 16 are in contact with a linear section of the tube 14 in order to have a large amount of surface contact with the tube 14. The segments 22 of the oppositely positioned tracks 16 surround the tube 14, providing improved gripping.

Figure 4:
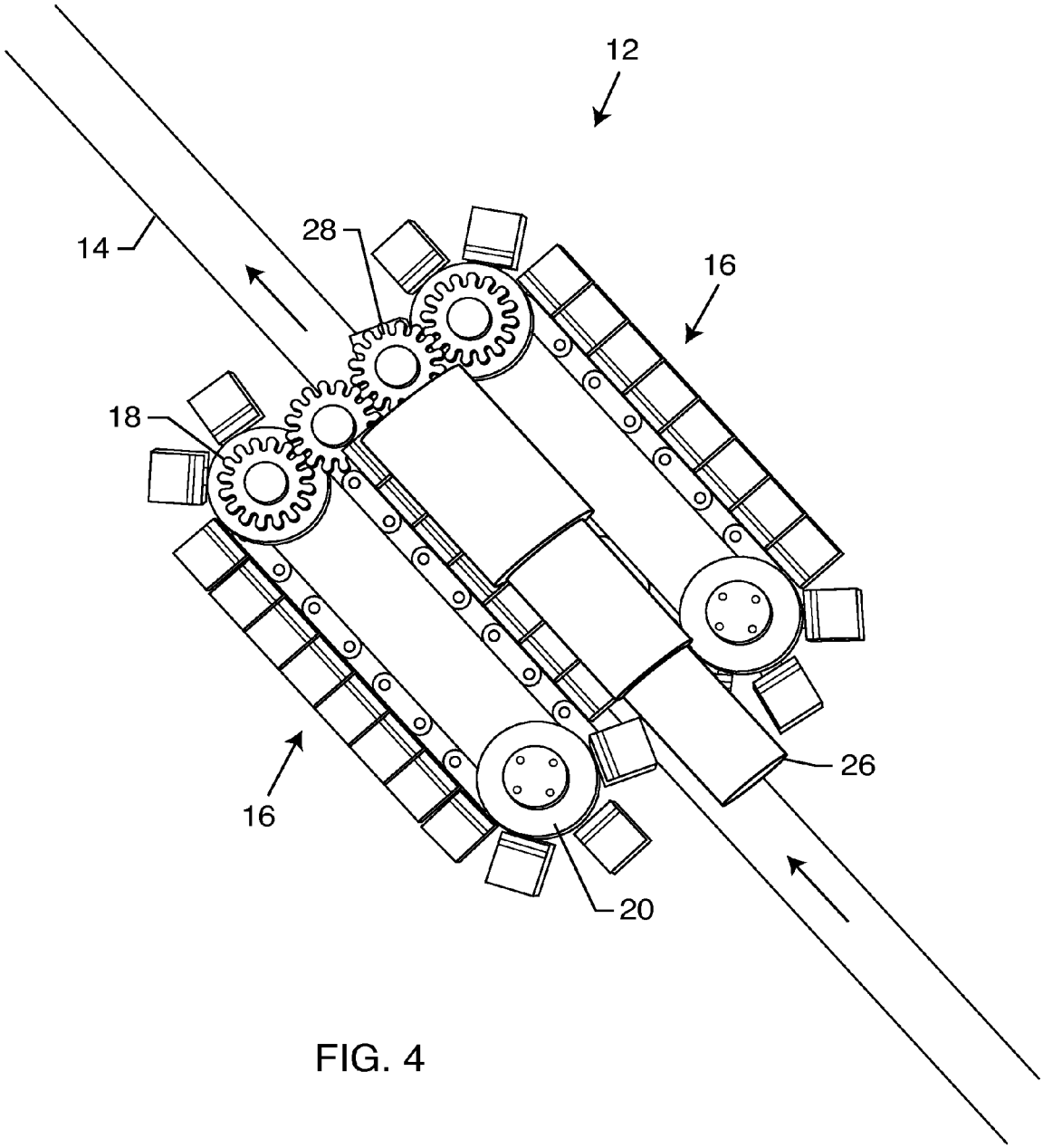
FIG. 4 shows the dual track drive with the servo drive motor and transfer gears on drive and idler shafts.

A servo motor 26, as shown in FIG. 4, is used to provide power or rotational motion to the dual track drive 12. The servo motor 26 rotates transfer gears 28, which rotate the drive sprockets 18 and in turn move the tracks 16 and segments 22. The tube product 14 is shown and the direction of the material flow within the track drive 12 is shown by the arrows. The motion of the track drive 12 may be stopped or held by a disk break (not shown) located inside or near the servo motor 26. FIG. 4 clearly shows the drive sprockets 18 that are driven by the servo motor 26 and the idler sprockets 20 that complete the loop or circular motion of each of the two tracks 16.

Figure 5:
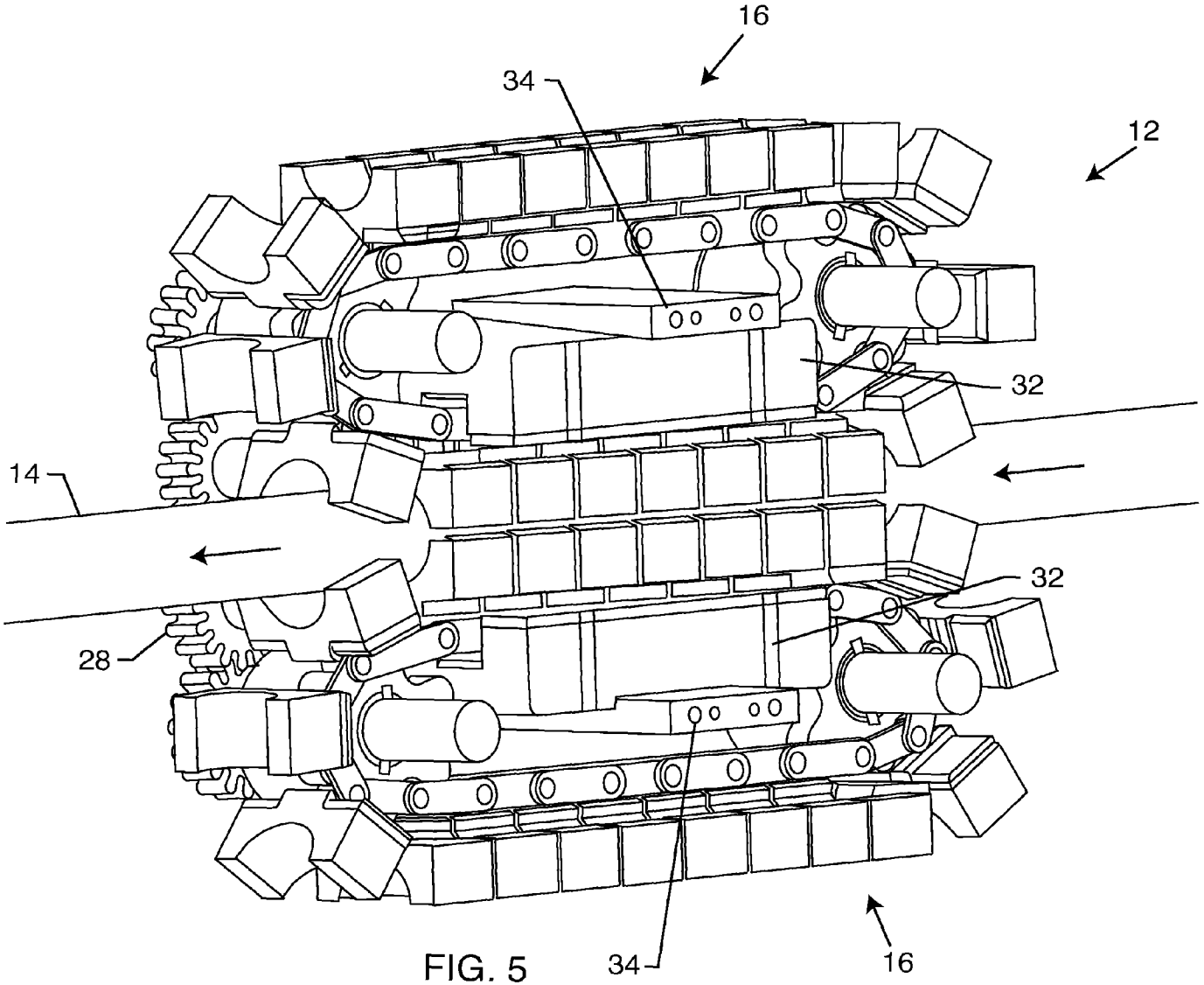
FIG. 5 shows the dual track drive with the slide-wedge assembly in each of the linearly rotating tracks.
Figure 6:
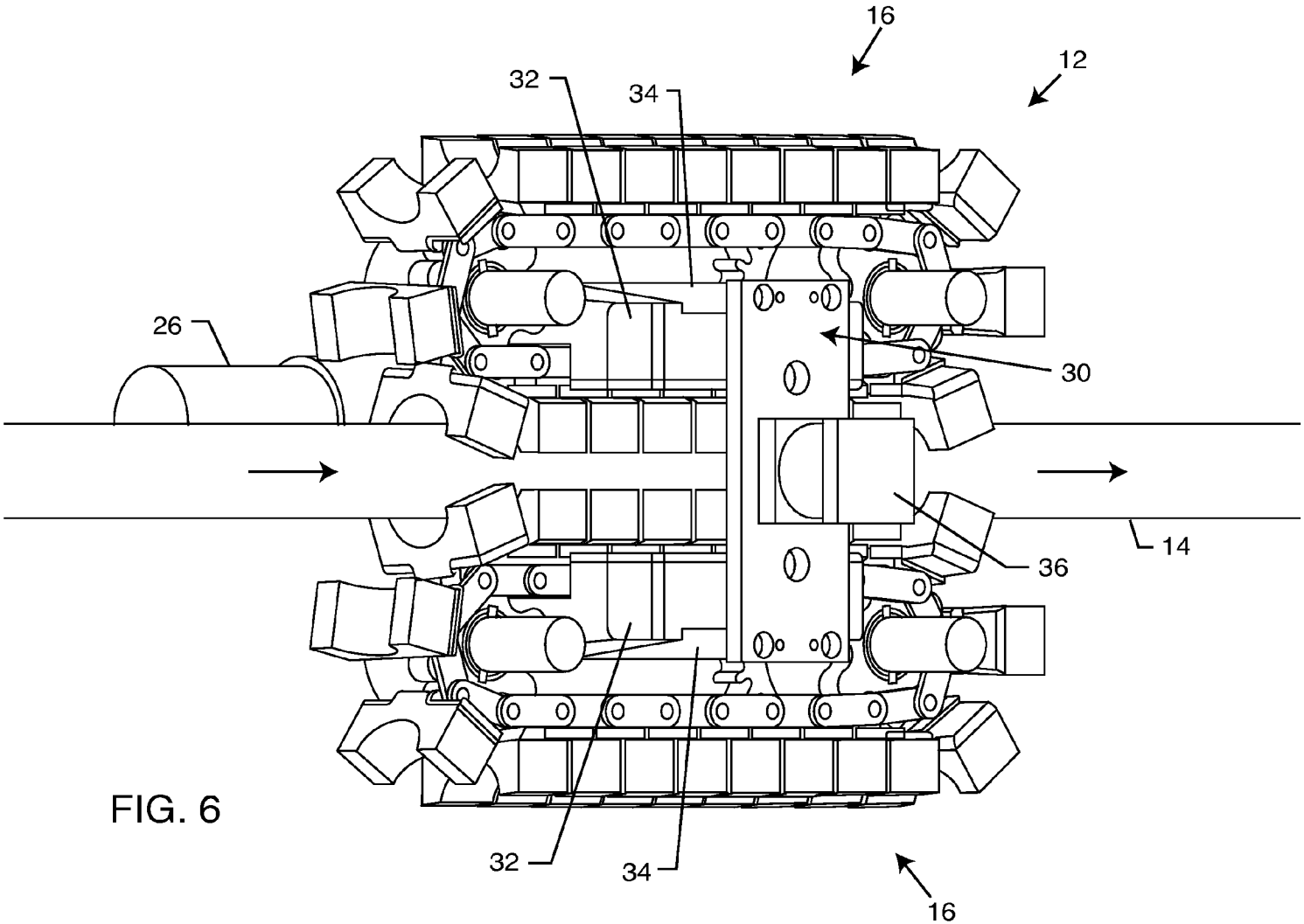
FIG. 6 shows the pneumatic or hydraulic cylinder to actuate slide-wedge assembly on the dual track drive.

Within each of the tracks 16, is a slide-wedge assembly 30 which forces contact of several opposing segments 22 of each of the tracks 16 to the tube product 14. FIG. 5 shows the placement of the slide 32 and wedge 34 in each track 16. Clamping of the tube product 14 is achieved through the use of linear motion, as provided from a cylinder 36 to the slide-wedge assembly 30. As seen in FIG. 6, as the cylinder 36 moves inward against the wedges 34, the wedges 34 force each slide 32 against the adjacent segments 22. This clamping movement from both slides 32 forces contact between the track segments 22 and the tube product 14. Therefore, there is direct contact between the track drive segments 22 and the tube product 14 while the servo motor 26 turns the sprockets to rotate the tracks 16 and move the tube product 14 in the material flow direction. The slides 32 and segments 22 are configured such that one slides over the other even under the pressure exerted by the slide-wedge assembly 30. The track drive segments 22 release the tube product 14 when the cylinder releases the wedge 34 and the force upon the slides 32 and the tube product 14.

Figure 7:
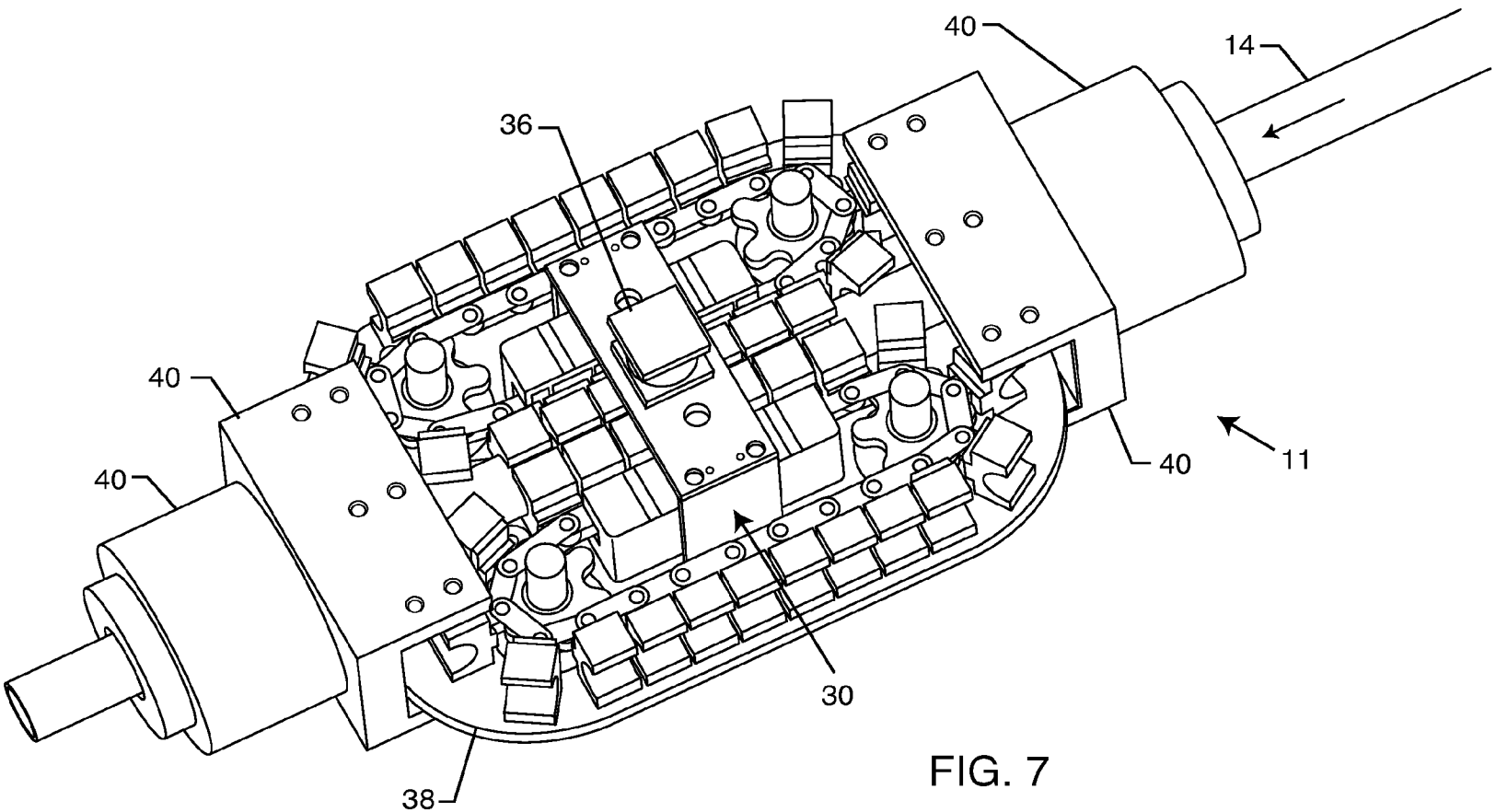
FIG. 7 shows the end supports and the base plate on the sub-assembly of the present invention.
Figure 8:
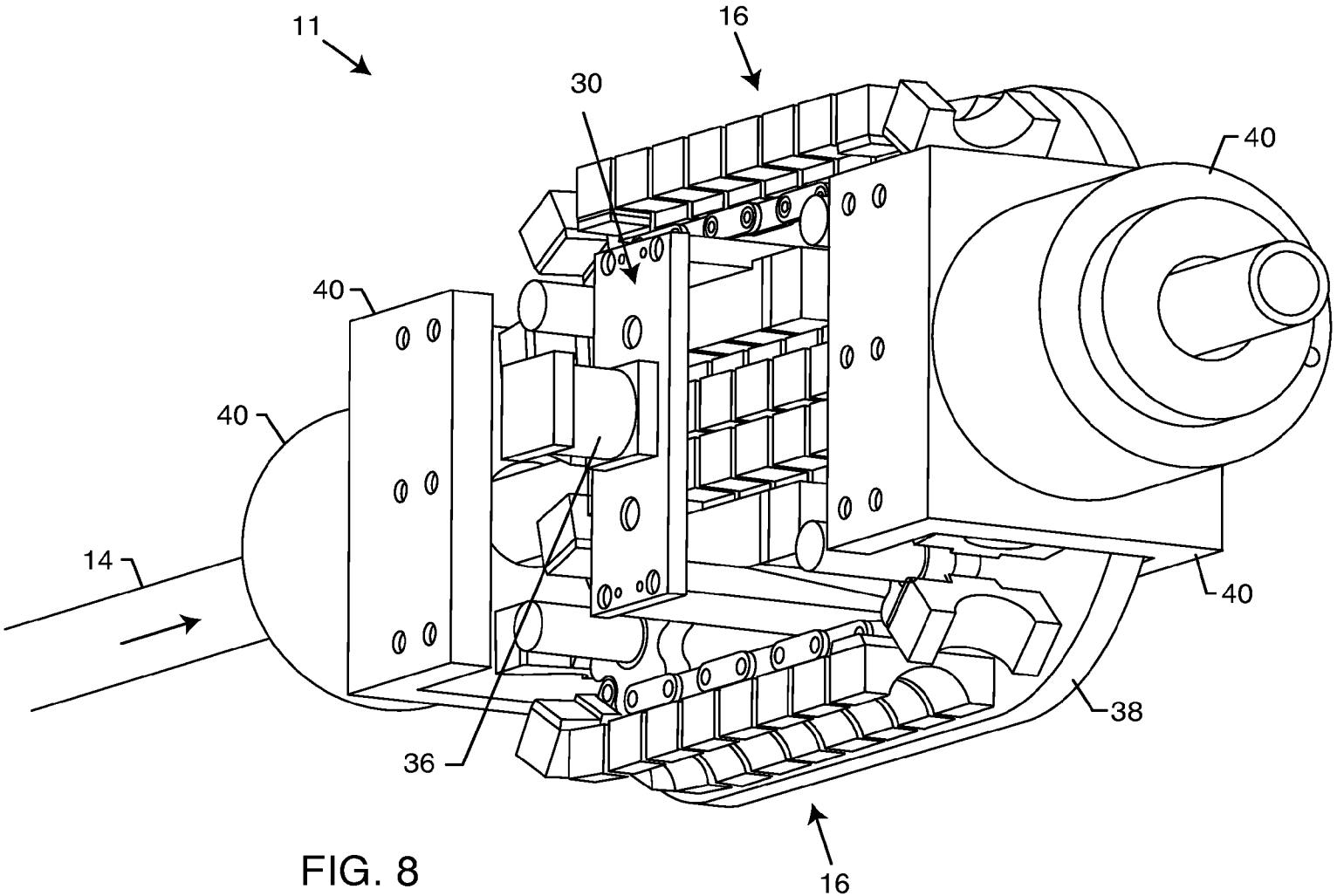
FIG. 8 shows the end supports and the base plate on the sub-assembly of the present invention.
Figure 9:
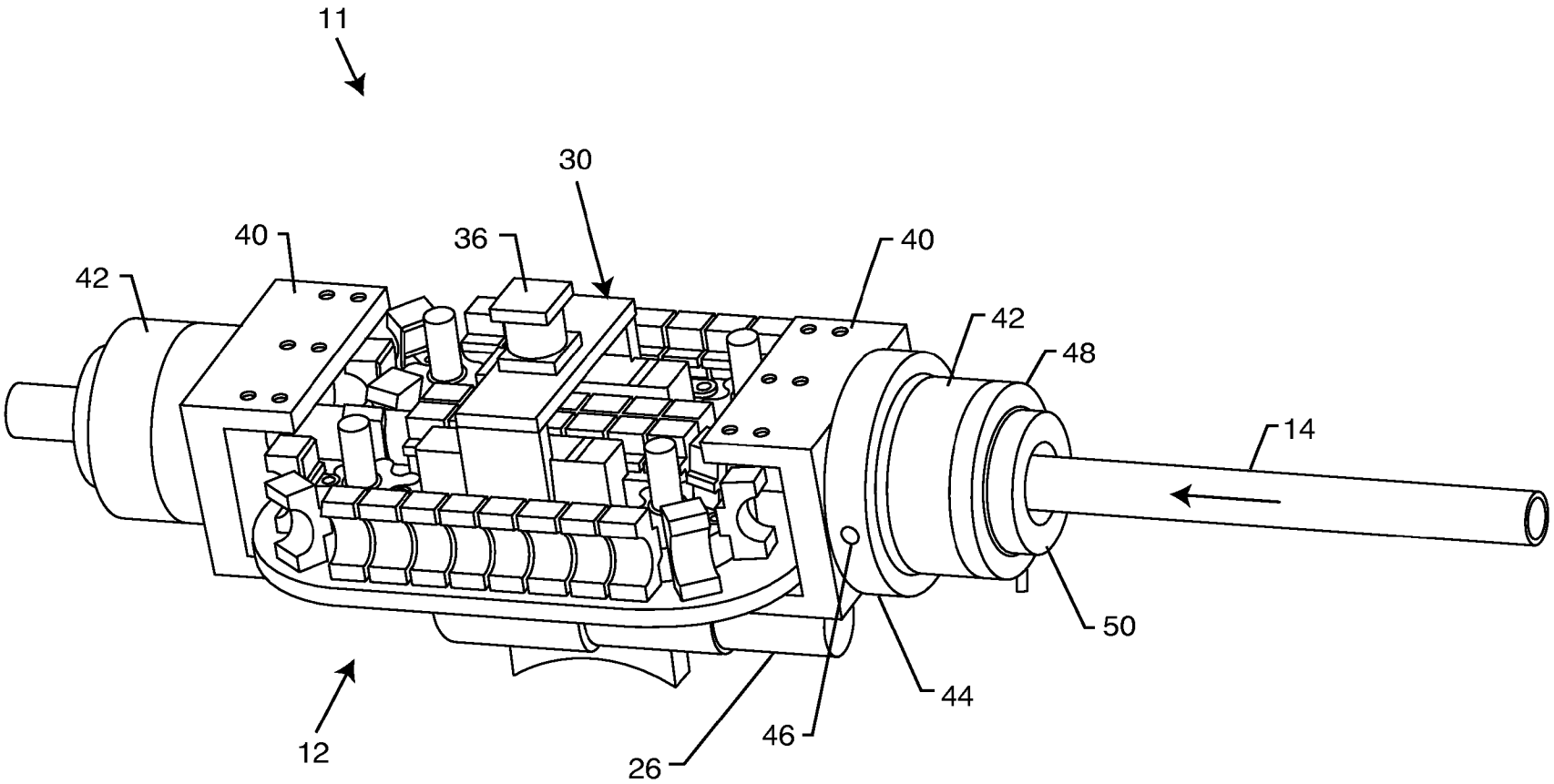
FIG. 9 shows the end supports with the rotary union, the electrical slip ring and hydraulic ring cylinder.
Figure 10:
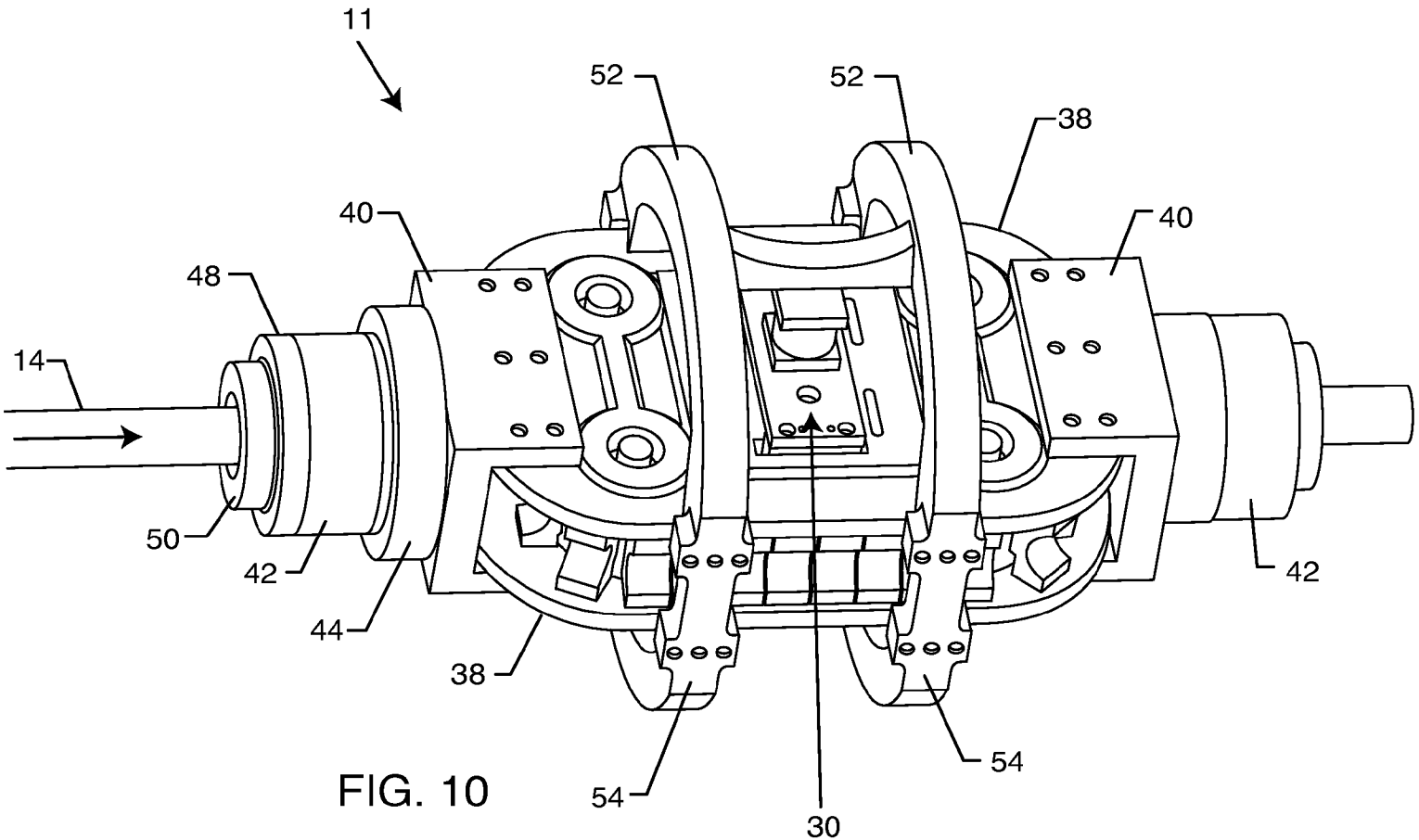
FIG. 10 shows the mounting of two ring bearings and the upper base plate on the sub-assembly.

The track drive assembly 12 is mounted on two base plates 38. For viewing purposes, only one plate 38 and how the assemblies are located on the plate is shown in FIGS. 7, 8 and 9. The second base plate 38 is positioned on the opposite side of the track drive 12 as shown in FIG. 10. Also, as shown in FIGS. 7 and 8, there are two end supports 40 mounted on each end of the plates 38. The end supports 40 provide a mount for active components as described below.

FIG. 9 shows the sub-assembly 11 of the gearbox 10 without a housing (shown below). Support bearings 42 are mounted on the end supports 40 in order to allow for full 360 degree rotation of the sub-assembly 11.

Also mounted on an end support 40 is a rotary union 44 providing pneumatic or hydraulic pressure to the gearbox 10. The rotary union 44 allows for pressure to be transferred from a stationary, external source (not shown) to the rotating sub-assembly 11 upon which the cylinder 36 is mounted. As described, the cylinder 36 operates the slide-wedge assembly 30. A hole 46 is provided in the rotary union 44 for a pneumatic or hydraulic line (not shown) to be attached and provide a source of pressure to the cylinder 36.

Also mounted on an end support 40 is an electrical slip ring 48 which allows electrical current to be transmitted from a stationary, external source (not shown) to the rotating sub-assembly 11 upon which the servo motor 26 is mounted. As described, the servo motor 26 drives the track drive 12 of the sub-assembly 11.

Also shown in FIG. 9, is a hydraulic ring cylinder 50 that is mounted on an end support 40. The hydraulic ring cylinder 50 provides small linear movement or bumping of the entire sub-assembly 11. The amount of linear movement or bumping is adjustable and can be as much as ½ inch or nearly no movement at all. As described, bumping is used to release the tube product 14 from the tooling inside the pilger mill.

FIG. 10 shows the complete sub-assembly 11, including both the top and bottom base plates 38. Also shown are two ring supports 52 around the assembly 11 which allow the entire sub-assembly 11 to be mounted on bearings 54. The bearings 54 are mounted to the ring supports 52. With bearings 54 located on the two ring supports 52 and the two end supports 40, the entire sub-assembly 11 is able to rotate in a nearly frictionless manner about a longitudinal axis coinciding with the tube product 14. Each of these four main bearings 54 is fit within a bronze sleeve that allows the entire sub-assembly 11 to be bumped by the hydraulic ring cylinder 50.

Alternatively, the ring supports 52 and related structures may be omitted and replaced by a plurality of stiffener bars. The stiffener bars run the length of the sub-assembly 11 and are positioned at the edges of the base plates 38. The ends of the stiffener bars are attached to the end supports 40 and provide additional support to the entire sub-assembly 11. With the ring supports 52 removed, the sub-assembly 11 rotates in the gearbox housing 58 solely upon the support bearings 42. Such structure works best when the gearbox 10 is of a smaller design.

Figure 11:
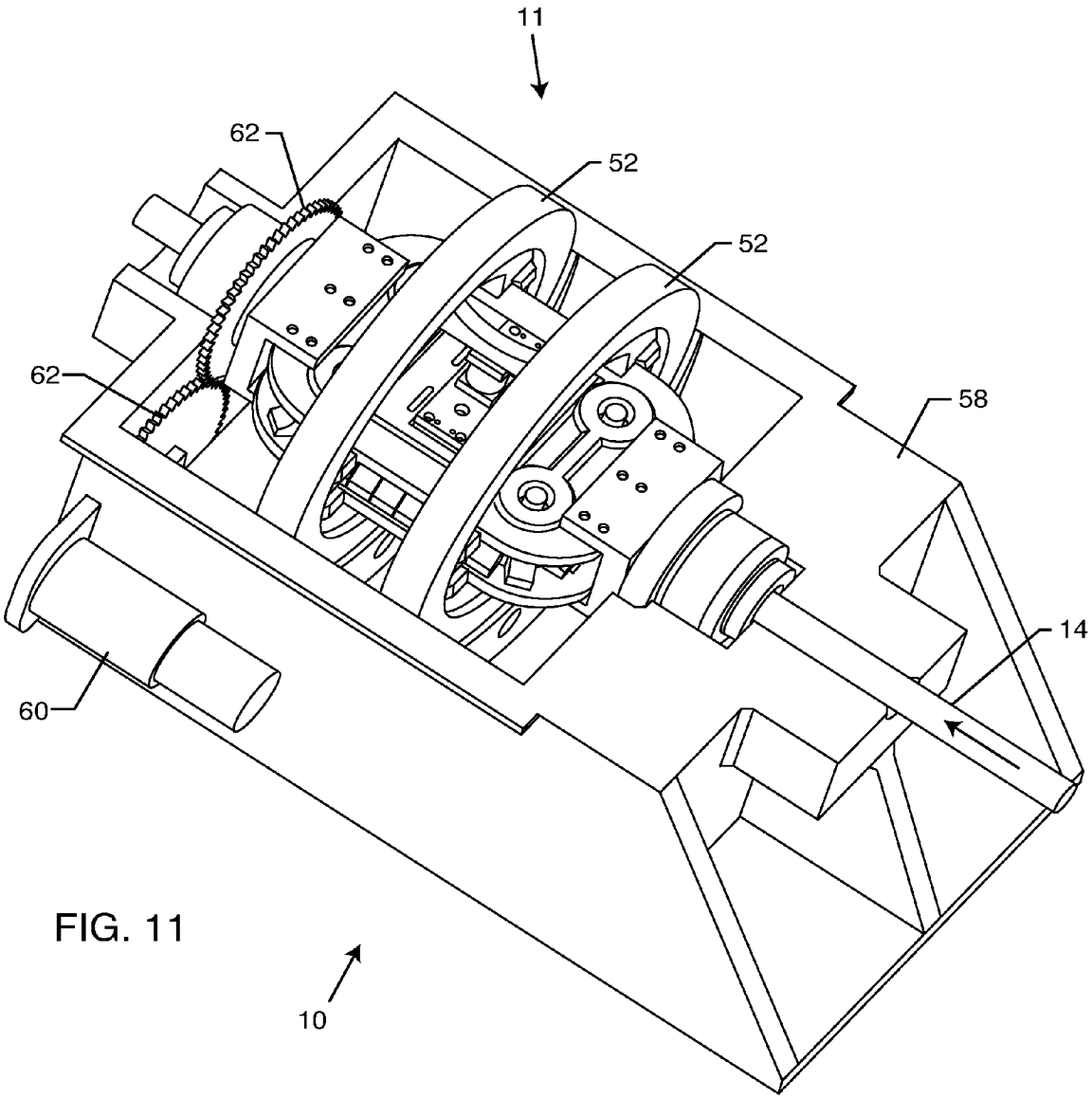
FIG. 11 illustrates how the use of ring bearings facilitate the rotation of the sub-assembly in the gearbox casing.
Figure 12:
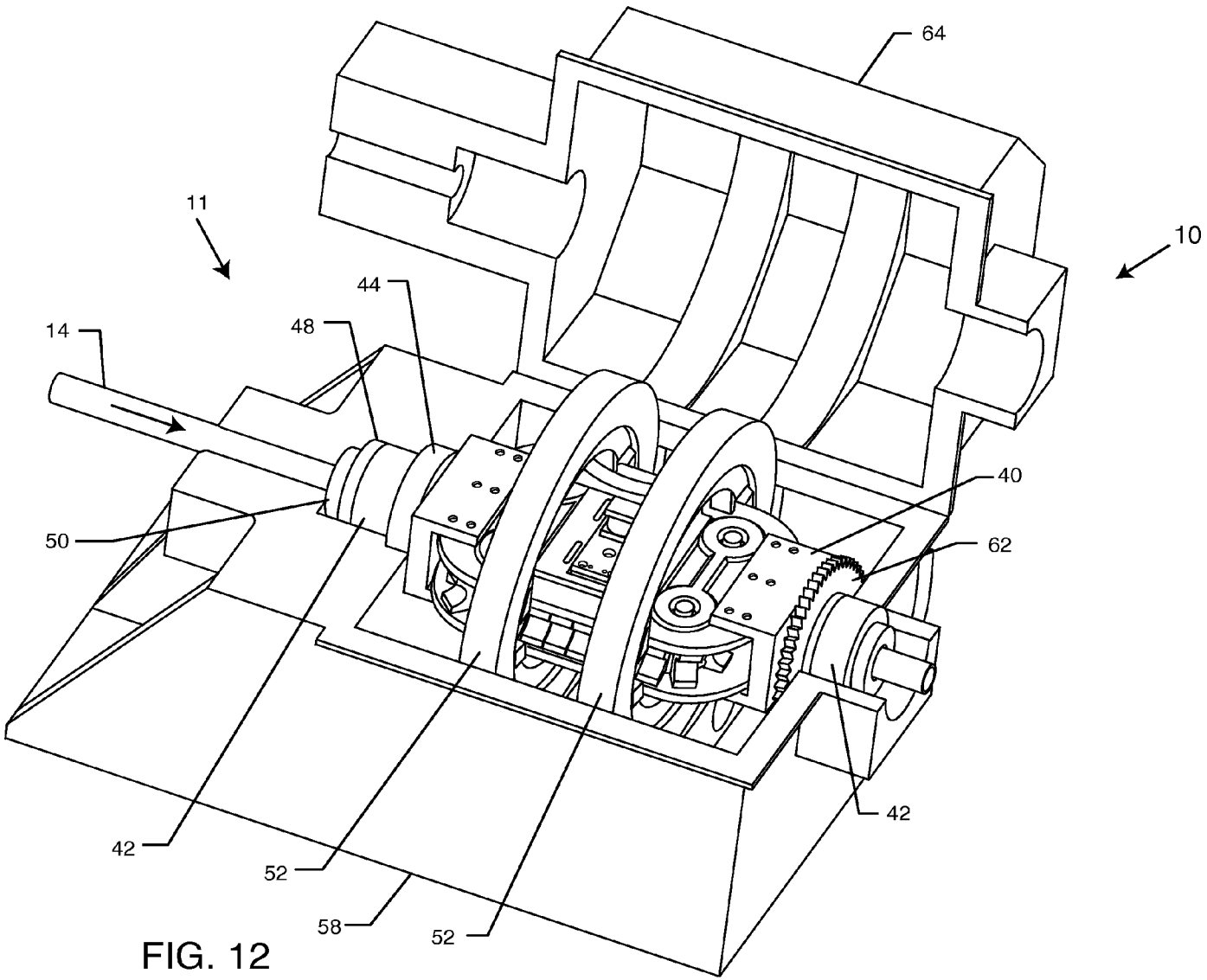
FIG. 12 shows the sub-assembly mounted in the complete gearbox casing.

FIG. 11 shows how the sub-assembly 11 is mounted into the lower gearbox housing 58. A servo drive 60, used to rotate the entire sub-assembly 11, is located on the outside of the lower housing 58. The rotation of the servo drive 60 is transferred to the sub-assembly 11 by gears 62. One gear 62 is mounted onto a end support 40 and a transfer gear is mounted on the housing 58 to transfer the rotary motion from the servo drive 60 to the sub-assembly 11. A disc brake (not shown) mounted internally or externally of the servo drive 60, is used to stop the rotation of the sub-assembly 11 when needed. FIG. 12 shows the completely assembled gearbox 10 with the upper housing 64 open so the sub-assembly 11 can be seen.

The inventive gearbox 10 is used to provide turning and feeding of incoming tube products 14 into the tooling of a pilger mill. The pilger mill reduces or works the incoming tube 14 into a smaller size both on outer diameter and inner diameter. For purposes of understanding, the function of a pilger mill is briefly explained.

As is common to pilger mills, this reduction of tube product 14 is accomplished by tooling of the pilger mill comprising a set of round dies and a mandrel. The outer diameter reduction of the incoming tube 14 is performed by dies which work the tube outer diameter when the dies rotate and travel. The incoming tube 14 inner diameter is formed by a mandrel while the dies reduce the tube outer diameter. The tube inner diameter and consequently the tube wall, is worked at the same time the tube outer diameter is reduced or formed.

As the tooling performs the work or the metal reduction, the rotation and travel of the tooling is controlled by a saddle. The saddle is moved back and forth by means of a mechanical drive, via a single crankshaft, or a bull gear system, or a multiple crank system, or a multiple gear system or other similar devices. The single back and forth movement of the saddle is described as one stroke. This functionality is separate from the feeding, turning and bumping of the gearbox 10 described above.

During the pilgering process, the incoming tube 14 is held or clamped in position momentarily by the gearbox 10 while the tooling reduces the tube product. After the pilger mill tooling has completed a stroke, the gearbox 10 incrementally moves the tube 14 forward a pre-determined amount, known as feeding. At the same time, the gearbox 10 indexes (rotates) the tube 14 a pre-determined amount. At the same time, the gearbox 10 bumps the tube 14 to release it from the mandrel.

The clamping or holding of the tube 14 is achieved by holding the dual track drive 12 stationary such that the segmented clamps 22 which are in contact with a portion of the tube 14 and compressed by the slide-wedge assembly 30, as described above, securely hold the tube 14. The feeding and turning, as described, may occur either at one or both end positions of the stroke of the saddle as it is mechanically moved. These end saddle positions are known in the art as entry and exit positions. The tooling is not reducing or in contact with the incoming tube 14 at either the entry or exit positions, therefore the tube 14 is free to be fed and indexed. After each feeding and indexing of the incoming tube 14, the tooling resumes the reduction process again on each stroke.

Although an embodiment has been described in detail for purposes of illustration, various modifications may be made without departing from the scope and spirit of the invention. Accordingly, the invention is not to be limited, except as by the appended claims.

What is claimed is:

1. A single gearbox for providing feed, index and bump motion of tube product in a pilger mill, the gearbox including a sub-assembly comprising:

a track drive including a linearly rotating track for feeding the tube product along a longitudinal axis of the sub-assembly;

an end support attached to an end of the sub-assembly for rotating the sub-assembly about the longitudinal axis, thereby indexing the tube product; and a hydraulic ring cylinder attached to an end of the sub-assembly for shifting the sub-assembly along the longitudinal axis, thereby bumping the tube product.

2. The single gearbox of claim 1, wherein the track drive comprises a dual track drive having two linearly rotating tracks, wherein the linearly rotating tracks comprise a looped series of segmented clamps contoured to the shape of the tube product.

3. The single gearbox of claim 1, wherein the end support comprises a pair of end supports attached to opposite ends of the sub-assembly.

4. The single gearbox of claim 1, wherein the track drive further comprises a slide-wedge assembly for forcing a portion of the linearly rotating track against the tube product.

5. The single gearbox of claim 4, further comprising a rotary union attached to an end of the sub-assembly, providing a point of connection for an external pneumatic or hydraulic source to the sub-assembly, the pneumatic or hydraulic source for actuating a cylinder acting on the slide-wedge assembly.

6. The single gearbox of claim 1, further comprising an electrical slip ring attached to an end of the sub-assembly, providing a point of connection for an external electrical source to the sub-assembly, the electrical source for powering a servo motor acting on the track drive.

7. The single gearbox of claim 1, further comprising a ring bearing disposed proximate to a longitudinal mid-point of the sub-assembly, the ring bearing operatively connected to a gearbox casing to facilitate rotating of the sub-assembly about the longitudinal axis.

8. The single gearbox of claim 7, wherein the ring bearing comprises a pair of ring bearings uniformly spaced about the longitudinal mid-point of the sub-assembly.

9. The single gearbox of claim 7, further comprising a servo drive on the gearbox casing for acting on the end support to rotate the sub-assembly.

10. A single gearbox for providing feed, index and bump motion of tube product in a pilger mill, the gear box including a sub-assembly comprising:

a dual track drive including two linearly rotating tracks for feeding the tube product along a longitudinal axis of the sub-assembly;

a pair of end support attached to opposite ends of the sub-assembly for rotating the sub-assembly about the longitudinal axis, thereby indexing the tube product; and a hydraulic ring cylinder attached to an end of the sub-assembly for shifting the sub-assembly along the longitudinal axis, thereby bumping the tube product.

11. The single gearbox of claim 10, wherein the linearly rotating tracks comprise a looped series of segmented clamps contoured to the shape of the tube product.

12. The single gearbox of claim 10, wherein the track drive further comprises a slide-wedge assembly for forcing opposing portions linearly rotating tracks against the tube product.

13. The single gearbox of claim 12, further comprising a rotary union attached to an end of the sub-assembly, providing a point of connection for an external pneumatic or hydraulic source to the sub-assembly, the pneumatic of hydraulic source for actuating a cylinder acting on the slide-wedge assembly.

14. The single gearbox of claim 10, further comprising an electrical slip ring attached to an end of the sub-assembly, providing a point of connection for an external electrical source to the sub-assembly, the electrical source for powering a servo motor acting on the track drive.

15. The single gearbox of claim 10, further comprising a pair of ring bearings uniformly spaced about a longitudinal mid-point of the sub-assembly, the ring bearings operatively connected to a gearbox casing to facilitate rotating of the sub-assembly about the longitudinal axis.

16. The single gearbox of claim 15, further comprising a servo drive on the gearbox casing for acting on gears and bearings in the end support to rotate the sub-assembly.

17. A single gearbox for providing feed, index and bump motion of tube product in a pilger mill, the gear box including a sub-assembly comprising:

a dual track drive including two linearly rotating tracks comprising a looped series of segmented clamps for feeding the tube product along a longitudinal axis of the sub-assembly, and a slide-wedge assembly for forcing opposing series of the segmented clamps on each of the rotating tracks against the tube product;

a pair of end supports attached to opposite ends of the sub-assembly for rotating the sub-assembly about the longitudinal axis, thereby indexing the tube product;

a hydraulic ring cylinder attached to an end of the sub-assembly for shifting the sub-assembly along the longitudinal axis, thereby bumping the tube product; and a pair of ring bearings uniformly spaced about a longitudinal mid-point of the sub-assembly, the ring bearings operatively connected to a gearbox casing to facilitate rotating of the sub-assembly about the longitudinal axis.

18. The single gearbox of claim 17, wherein the segmented clamps are contoured to the shape of the tube product.

19. The single gearbox of claim 17, further comprising a rotary union attached to an end of the sub-assembly, providing a point of connection for an external pneumatic or hydraulic source to the sub-assembly, the pneumatic of hydraulic source for actuating a cylinder acting on the slide-wedge assembly.

20. The single gearbox of claim 17, further comprising an electrical slip ring attached to an end of the sub-assembly, providing a point of connection for an external electrical source to the sub-assembly, the electrical source for powering a servo motor acting on the track drive.

21. The single gearbox of claim 17, further comprising a servo drive on the gearbox casing for acting on gears and bearings in the end support to rotate the sub-assembly about the longitudinal axis.

* * * * *